US005766039A

United States Patent [19]

Abe

[11] Patent Number: 5,766,039

[45] Date of Patent: Jun. 16, 1998

[54] WATERPROOF CONNECTOR WITH PRESSING HOLES IN SEAL MEMBER

[75] Inventor: Kimihiro Abe, Shizuoka, Japan

[73] Assignee: Yazaki Corporation, Tokyo, Japan

[21] Appl. No.: 832,669

[22] Filed: Apr. 4, 1997

[30] Foreign Application Priority Data

Apr. 5, 1996 [JP] Japan ..... 8-084122

[51] Int. Cl.[6] ..... H01R 13/40

[52] U.S. Cl. ..... 439/587

[58] Field of Search ..... 439/587, 588, 439/589, 274, 275, 279

[56] References Cited

U.S. PATENT DOCUMENTS 5,145,410 9/1992 Maejima et al. ..... 439/587

5,632,653 5/1997 Sawada ..... 439/587

*Primary Examiner*—Hien Vu

*Assistant Examiner*—Barry M. L. Standig

*Attorney, Agent, or Firm*—Sughrue, Mion, Zinn, Macpeak & Seas, PLLC

[57] ABSTRACT

A waterproof connector 1 of the invention includes a housing body 2 having a plurality of terminal receiving chambers 4 for respectively receiving a plurality of crimp-style terminals 5 each clamped to a wire W, a cover 3 covering the housing body 2 from a front side thereof, a mat seal 6 of an elastic material which is provided between the housing body 2 and the cover 3, and has a plurality of wire seal holes 7, and a rear holder 10 which is fitted on the mat seal 6 from a rear side thereof, and is engaged with the cover 3. Slits 8 are formed in the mat seal 6, and extend respectively from the wire seal holes 7 to an outer peripheral surface of the mat seal, and pressing holes 9 are formed in a rear surface of the mat seal 6 in such a manner that each of the slits 8 is disposed between the corresponding adjacent pressing holes 9, and tapering projections 11 are formed on a front surface of the rear holder 10, and the tapering projections 11 are pressed respectively into the pressing holes 9 to increase the diameters of the pressing holes 9, respectively, when the rear holder is engaged with the cover 3.

6 Claims, 6 Drawing Sheets

WATERPROOF CONNECTOR WITH PRESSING HOLES IN SEAL MEMBER

BACKGROUND OF THE INVENTION

1. Field of the Invention

This invention relates to a waterproof connector in which crimp-style terminals, clamped to ends of respective wires, can be received respectively in terminal receiving chambers without adversely affecting a waterproof function.

2. Related Art

Various kinds of waterproof connectors are already known. For example, waterproof connectors, disclosed in U. S. Pat. No. 4,810,205 and Japanese Utility Model Unexamined Publication No. 49-98789, are commonly known.

As shown in FIG. 6, a conventional waterproof connector 41 includes a housing body 42 having a plurality of terminal receiving chambers 4 for respectively receiving crimp-style female terminals 5 each having a wire W clamped to its rear end, and a cover 43 covering this housing body 42, the housing body 42 and the cover 43 being molded into an integral construction. A plate-like mat seal 46, made of an elastic material such as rubber, is fitted in a rear end portion 44 of the cover 43, and this mat seal 46 has a plurality of wire seal holes 7, and also has lips 47 formed on an outer peripheral surface thereof.

An annular seal 48, made of an elastic material such as rubber, is held between a front end portion of the cover 43 and a mating connector (not shown) to provide a waterproof seal. A retaining hole 45 is formed in an upper surface of the crimp-style terminal 5, and when the terminal is inserted into the housing body 42, a housing lance (not shown) is retainingly engaged in the retaining hole 45, thereby retaining the terminal against rearward withdrawal.

In the waterproof connector 41 of the above construction, first, the crimp-style terminals each having the wire W clamped thereto are forced respectively through the wire seal holes 7 in the mat seal 46, and then the mat seal 46 is fitted into the rear end portion 44 of the cover 43. At this time, the crimp-style terminals 5 are received respectively in the terminal receiving chambers 4 in the housing body 42, and are prevented from rearward withdrawal by the retaining holes 45. At the same time, the lips 47, formed on the outer peripheral surface of the mat seal 46, is fitted in the rear end portion 44 of the cover 43. Since each wire seal hole 7 tightens the associated wire W, water is prevented from intruding from the rear side of the cover 43 into the terminal receiving chamber 4.

Another conventional waterproof connector 51, shown in FIG. 7, includes a housing body 52 having a plurality of terminal receiving chambers 4 for respectively receiving a plurality of crimp-style male terminals 55 each having a wire W clamped to its rear end, and a cover 53 covering this housing body 52, the housing body 52 and the cover 53 being molded into an integral construction. A plate-like mat seal 56, made of an elastic material such as rubber, is fitted in a rear end portion 54 of the cover 53, and this mat seal 56 has a plurality of wire seal holes 7, and slits 8 each extending from an outer peripheral surface of the mat seal 56 to the associated wire seal hole 7.

In the waterproof connector 51 of the above construction, first, the wire W, clamped to the rear end of each crimp-style terminal 55, is forced through the slit 8 into the wire seal hole 7. Then, a group of crimp-style terminals 55 are inserted into a group of terminal receiving chambers 4 in the housing body 52.

At this time, the outer peripheral surface of the mat seal 56 is fitted in the rear end portion 54 of the cover 53, and each wire W is tightened by the associated wire seal hole 7. Therefore, water or the like is prevented from intruding from the rear side of the cover 53 and the wire seal holes 7 into the terminal receiving chambers 4.

Since the wire W is forced through the slit 8 to be held in the wire seal hole 7, the mounting operation is easy, and can be carried out efficiently.

However, in the above conventional waterproof connector 41, it is necessary to pass each crimp-style terminal 5 forwardly through the wire seal hole 7 in the mat seal 46 from the rear side thereof, and this invites a problem that the efficiency of the operation is lowered.

Another problem is that when passing the crimp-style terminal 5 through the wire seal hole 7, the wire seal hole 7 is damaged by the retaining hole 45, so that the waterproof effect is lowered.

In the above conventional waterproof connector 51, in order to solve the problems of the waterproof connector 41, the slits 8 are formed in the mat seal 56, thereby obviating the need for passing the crimp-style terminals 55 through the respective wire seal holes 7. However, because of the provisions of the slits 8, the sufficient waterproof effect can not be obtained merely by fitting the mat seal 56 into the cover 53, and there is encountered a problem that water under pressure intrudes through the slits 8, thus lowering the waterproof effect.

SUMMARY OF THE INVENTION

With the above problems in view, it is an object of this invention to provide a waterproof connector which can be easily assembled, and achieves an excellent waterproof effect.

The above object has been achieved by a waterproof connector of the invention comprising a housing body having a plurality of terminal receiving chambers for respectively receiving a plurality of crimp-style terminals each clamped to an end of a wire; a cover covering the housing body from a front side thereof; a mat seal of an elastic material which is fitted in a rear end portion of the cover, and has a plurality of wire seal holes; and a rear holder which is fitted on the mat seal from a rear side thereof, and is engaged with the cover;

Wherein slits are formed in the mat seal, and extend respectively from the wire seal holes to an outer peripheral surface of the mat seal; pressing holes are formed in a rear surface of the mat seal in such a manner that each of the slits is disposed between the corresponding adjacent pressing holes; and tapering projections are formed on a front surface of the rear holder, and are pressed respectively into the pressing holes to increase diameters of the pressing holes, respectively.

In the waterproof connector of this construction, the wire is first clamped to the rear end of each crimp-style terminal, and then the crimp-style terminals are received respectively in the terminal receiving chambers from the upper side. At this time, the wire is passed through the slit from the outer peripheral surface of the mat seal, and is received in the wire seal hole. Then, the cover is fitted on the housing body from the front side thereof, and the group of wires are received in the rear holder, and then the rear holder is fitted on the cover, and is engaged therewith.

At this time, the outer peripheral surface of the mat seal is fitted in the inner peripheral surface of the rear end portion of the cover, and the front surface of the mat seal is abutted against the rear end of the cover, and the rear surface of the mat seal is pressed toward the cover by the rear holder. At this time, the tapering projections, formed on the front surface of the rear holder, are pressed respectively into the pressing holes (provided in such a manner that each slit is disposed between the corresponding adjacent pressing holes) to increase the diameters of the pressing holes, respectively, and therefore each slit is pressed from the opposite sides, and opposed surfaces of the slit are pressed into intimate contact with each other, thus completely eliminating a gap defined by the slit.

Since the slits are formed in the mat seal, the insertion of the wires through the respective wire seal holes can be effected easily, and the efficiency of the operation is enhanced, and besides since the tapering projections are pressed respectively into the pressing holes, the slits are pressed from the opposite sides, thereby positively preventing the intrusion of water and the like.

The above object has also been achieved by a waterproof connector of the invention comprising a housing body having a plurality of terminal receiving chambers for respectively receiving a plurality of crimp-style terminals each clamped to an end of a wire; a cover covering the housing body from a front side thereof; a mat seal of an elastic material which is fitted in a rear end portion of the cover, and has a plurality of wire seal holes; and a rear holder which is fitted on the mat seal from a rear side thereof, and is engaged with the cover, wherein slits are formed in the mat seal, and extend respectively from the wire seal holes to an outer peripheral surface of the mat seal; pressing holes are formed in a front surface of the mat seal in such a manner that each of the slits is disposed between the corresponding adjacent pressing holes; tapering projections are formed on a rear surface of the cover, and are pressed respectively into the pressing holes to increase diameters of the pressing holes, respectively; and the housing body is molded integrally with the cover, and is disposed within the cover.

In the waterproof connector of this construction, the wire is first clamped to the rear end of each crimp-style terminal, and then the wire is passed through the slit from the outer peripheral surface of the mat seal, and is received in the wire seal hole, and also the crimp-style terminals are inserted respectively into the terminal receiving chambers from the rear end of the housing body. Then, the group of wires are received in the rear holder, and then the rear holder is fitted on the cover, and is engaged therewith.

At this time, the outer peripheral surface of the mat seal is fitted in the inner peripheral surface of the rear end portion of the cover, and the front surface of the mat seal is abutted against the rear end of the cover, and the rear surface of the mat seal is pressed toward the cover by the rear holder. At this time, the tapering projections, formed on the rear surface of the cover, are pressed respectively into the pressing holes, formed on the front surface of the mat seal in such a manner that each slit is disposed between the corresponding adjacent pressing holes, to increase the diameters of the pressing holes, respectively, and therefore each slit is pressed from the opposite sides, and opposed surfaces of the slit are pressed into intimate contact with each other, thus completely eliminating a gap defined by the slit.

Since the slits are formed in the mat seal, the insertion of the wires through the respective wire seal holes can be effected easily, and the wires are inserted respectively into the terminal receiving chambers after the wires are mounted respectively in the wire seal holes, and therefore the assembling operation can be effected more easily, thus further enhancing the efficiency of the operation.

The above object can be achieved by a waterproof connector, in which each of the pressing holes is a conical hole, and each of the tapering projections is a conical projection larger in volume than the conical hole.

In the waterproof connector of this construction, the pressing holes and the tapering projections are both conical in shape, and therefore the molding can be effected easily, and the production cost can be reduced.

The above object can be achieved by a waterproof connector of the present invention, in which each of the pressing holes is a triangular prism-shaped hole of a V-shaped cross-section extending in a direction of extending of the slit, and each of the tapering projections is a triangular prism-shaped projection larger in volume than the triangular prism-shaped hole.

In the waterproof connector of this construction, the tapering projections have a triangular prism-shape, and hence have an increased rigidity, and since the pressing holes have a triangular prism-shape, the length of application of the pressure to the slit is increased, and the waterproof effect at the slits is further enhanced, and the waterproof connector of a higher reliability can be obtained.

DETAILED DESCRIPTION OF THE PREFERRED EMBODIMENTS

Figure 1:
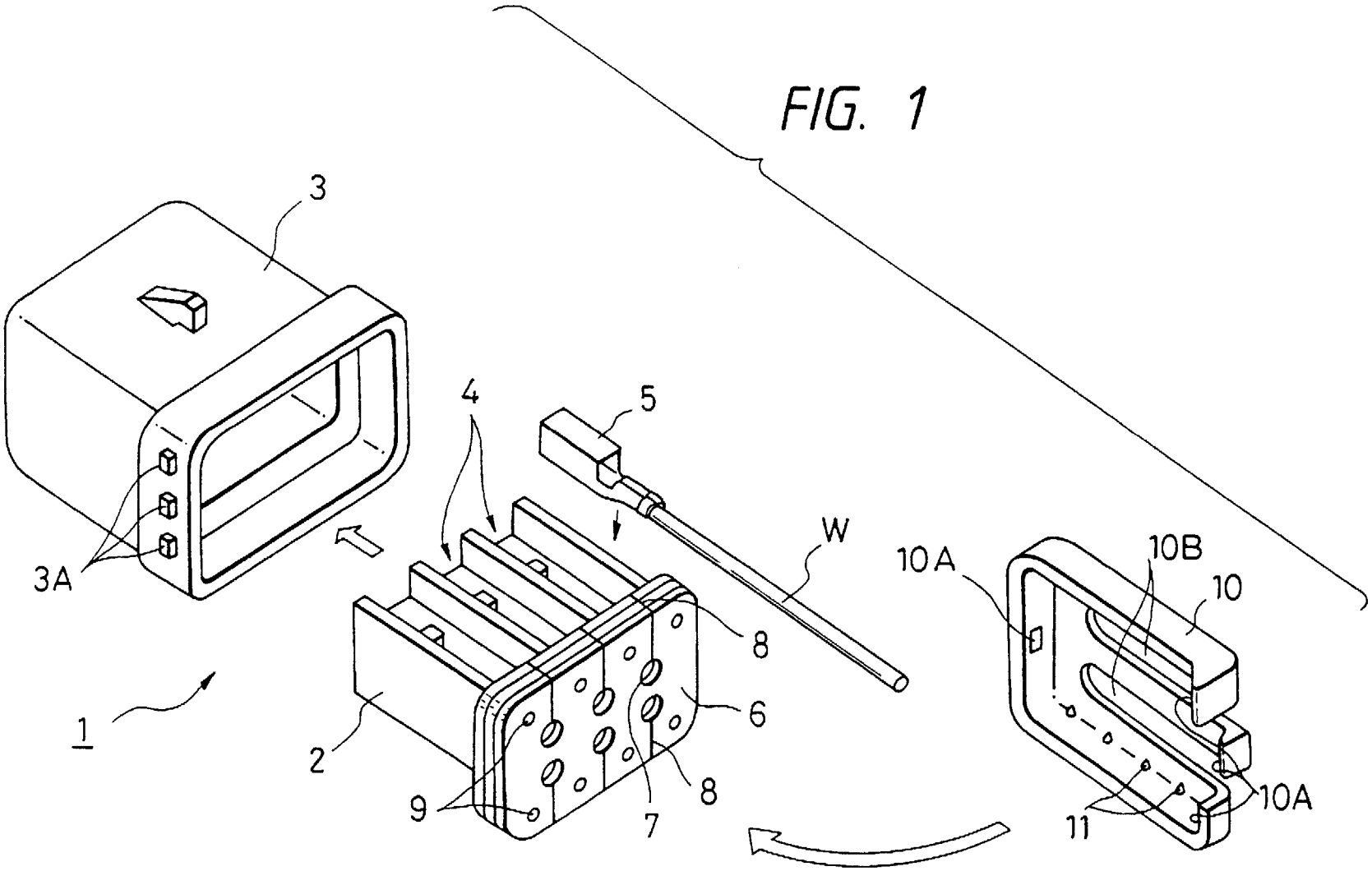
FIG. 1 is an exploded, perspective view of a first embodiment of a waterproof connector of the invention.
Figure 3:
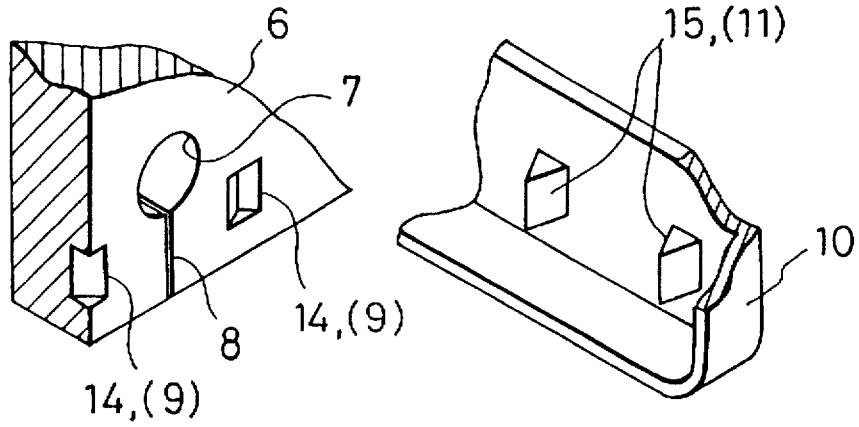
FIG. 3 is a fragmentary, enlarged perspective view showing pressing holes of another shape and tapering projections of another shape in FIG. 1.
Figure 4A:
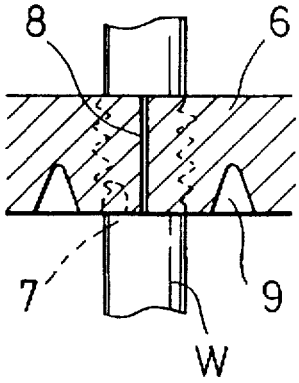
FIGS. 4(*a*)–4(*c*) are views taken along the line A—A of FIG. 2, showing an assembling operation, FIG. 4(*a*) showing a condition before a rear holder is attached to a mat seal, FIG. 4(*b*) showing a condition in the process of attaching the rear holder, and FIG. 4(*c*) showing a condition in which the attachment of the rear holder is completed.
Figure 4B:
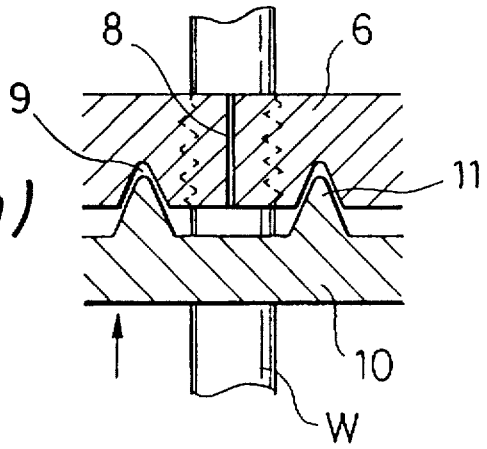
Figure 4C:
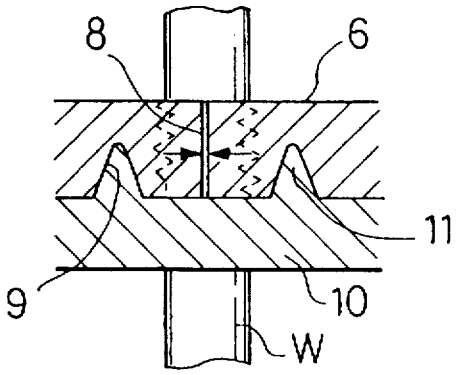
Figure 5:
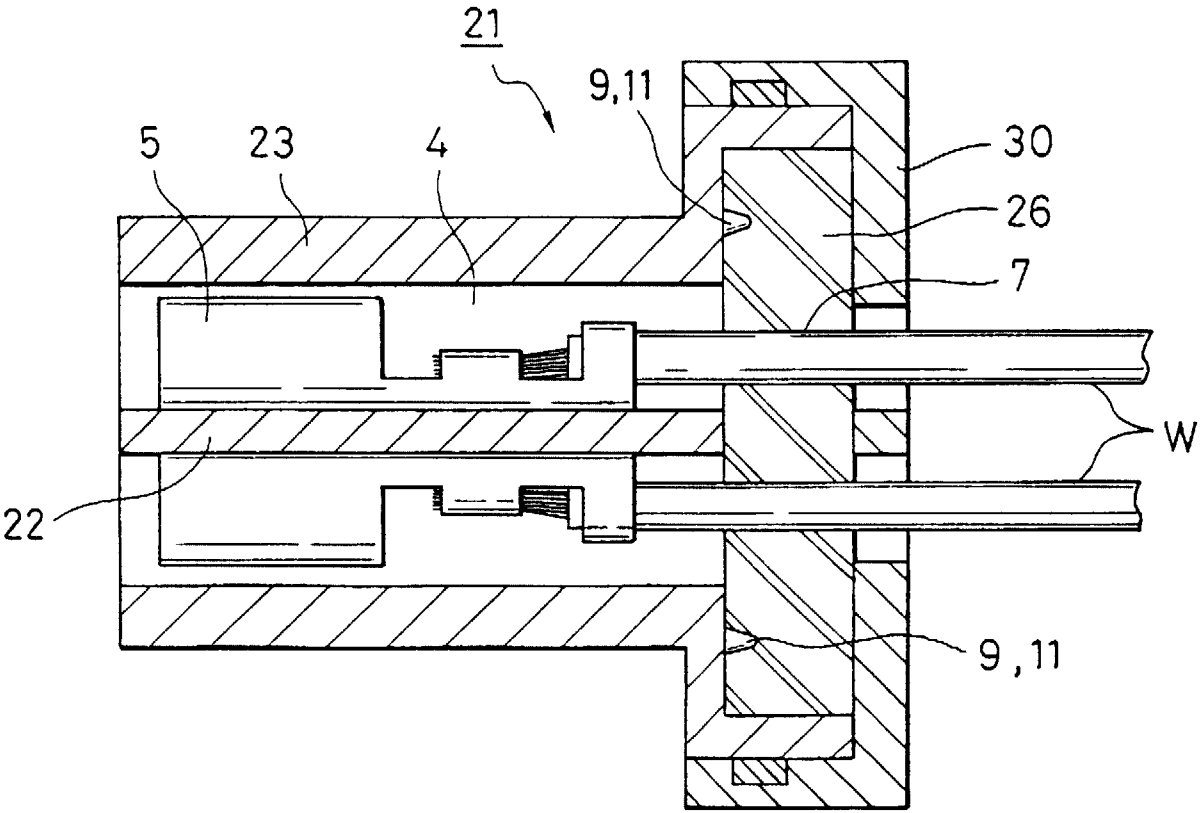
FIG. 5 is a vertical cross-sectional view of a second embodiment of a waterproof connector of the invention.
Figure 6:
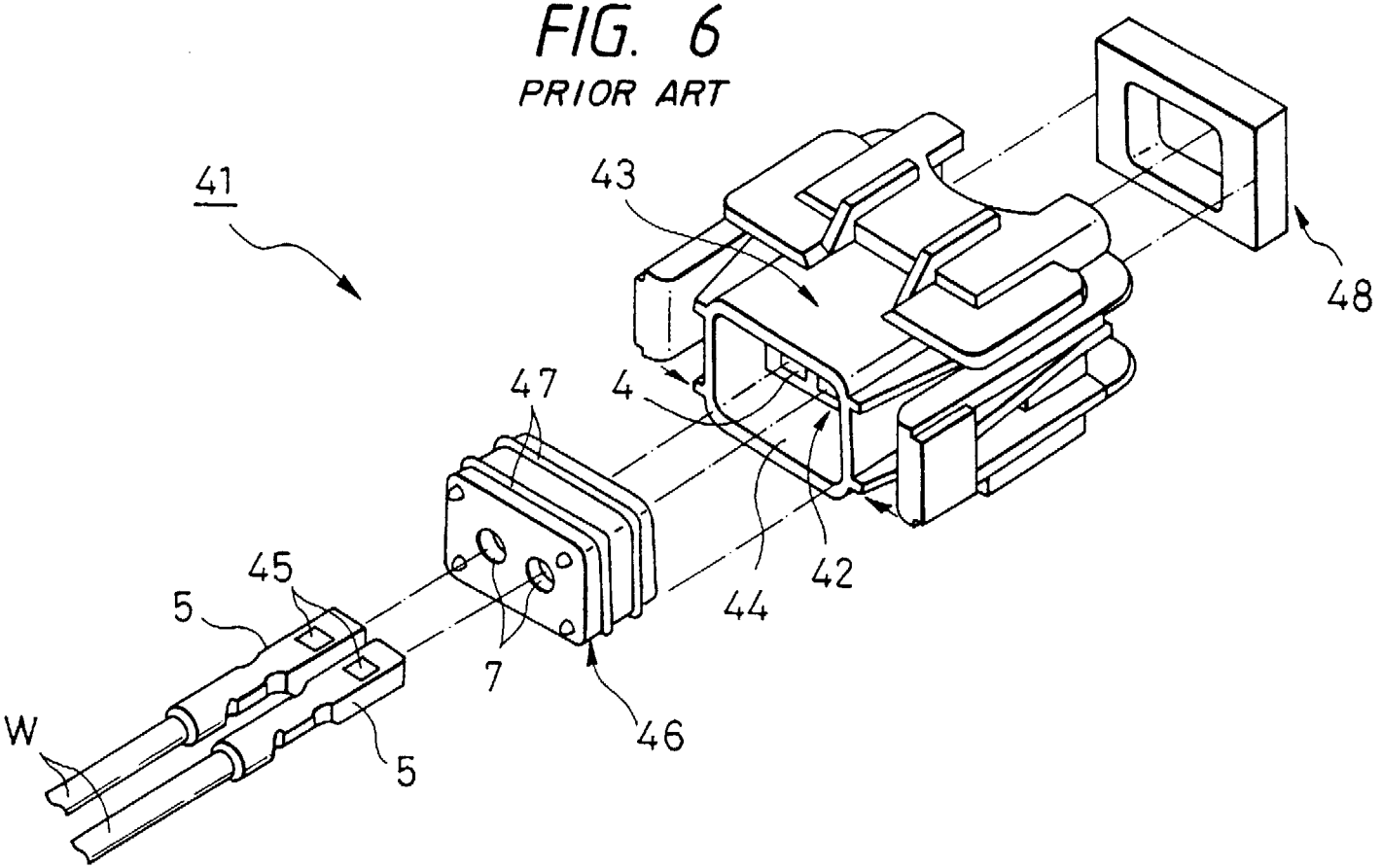
FIG. 6 PRIOR ART
FIG. 6 is an exploded, perspective view of a conventional waterproof connector.
Figure 7:
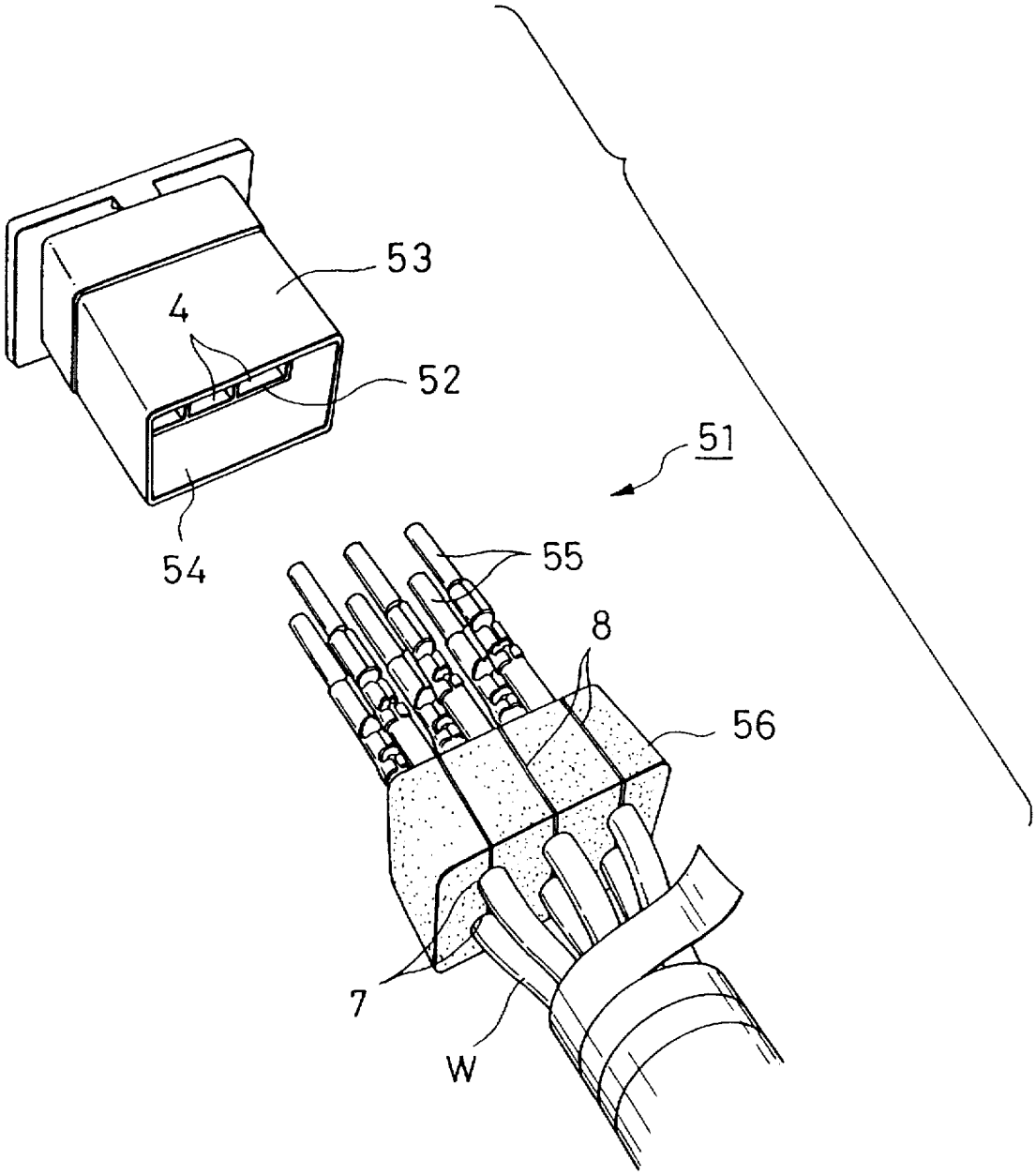
FIG. 7 PRIOR ART
FIG. 7 is an exploded, perspective view of another conventional waterproof connector.

Preferred embodiments of a waterproof connector of the present invention will now be described in detail with reference to FIGS. 1 to 5. FIG. 1 is an exploded, perspective view of a first embodiment of a waterproof connector of the invention, FIG. 2 is a fragmentary, enlarged perspective view showing pressing holes of one shape and tapering projections of one shape in FIG. 1, FIG. 3 is a fragmentary, enlarged perspective view showing pressing holes of another shape and tapering projections of another shape in FIG. 1, FIG. 4 is a view taken along the line A—A of FIG. 2, showing an assembling operation, and FIG. 5 is a vertical cross-sectional view of a second embodiment of a waterproof connector of the invention.

As shown in FIG. 1, the waterproof connector 1 of this embodiment includes a housing body 2 having a plurality of terminal receiving chambers 4 for respectively receiving a plurality of crimp-style female terminals 5 each having a wire W clamped to its rear end, a cover 3 covering this housing body 2 from a front side thereof, and a plate-like mat seal 6, which is made of an elastic material such as rubber, and is provided between the housing body 2 and the cover 3, and has a plurality of wire seal holes 7, and a rear holder 10 which is fitted on the mat seal 6 from a rear side thereof, and is engaged with the cover 3. The mat seal 6 has slits 8 extending respectively from the wire seal holes 7 to an outer peripheral surface thereof, and the pressing holes 9 are formed in a rear surface of the mat seal 6 in such a manner that each slit 8 is disposed between the corresponding adjacent pressing holes 9. The tapering projections 11 are formed on a front surface of the rear holder 10, and are pressed respectively into the pressing holes 9 to increases the diameters of the pressing holes 9, respectively.

The rear surface of the housing body 2 is fixedly secured to the front surface of the mat seal 6, so that the housing body 2 and the mat seal 6 are connected together into a unitary construction. Retaining pawls 10A are formed on an inner surface of the rear holder 10, and are retainingly engaged respectively with retaining projections 3A formed on an outer surface of the cover 3 at a rear end thereof. U-shaped openings 10B for receiving the wires W are formed in the rear holder 10, and extend laterally from one side thereof.

Figure 2:
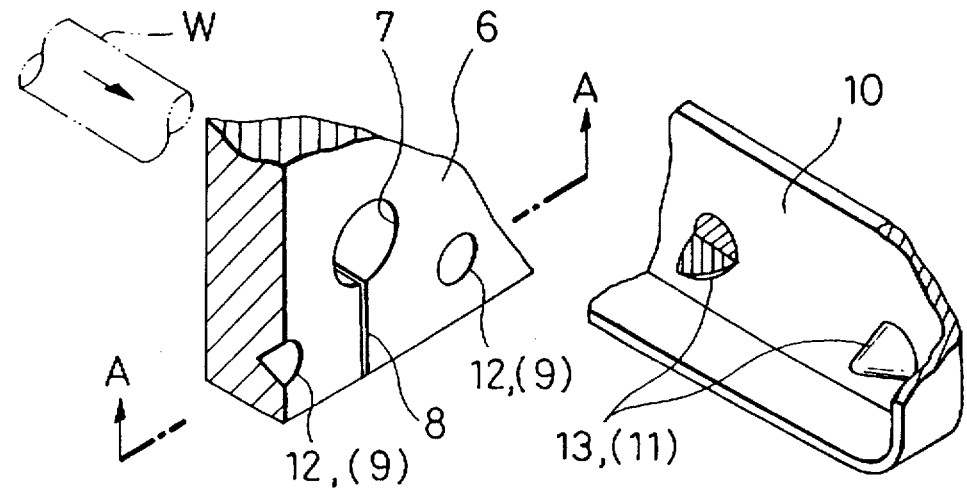
FIG. 2 is a fragmentary, enlarged perspective view showing pressing holes of one shape and tapering projections of one shape in FIG. 1.

More specifically, as shown in FIG. 2, each pressing hole 9 is in the form of a conical hole 12, and each tapering projection 11 is in the form of a conical projection 13 larger in volume than the conical hole 12.

As shown in FIG. 3, the pressing hole 9 may be in the form of a triangular prism-shaped hole 14 of a V-shaped cross-section extending in a direction of extending of the slit 8, and the tapering projection 11 may be in the form of a triangular prism-shaped projection 15 larger in volume than the triangular prism-shaped hole 14.

In the waterproof connector 1 of this embodiment having the above construction, the wire W is first clamped to the rear end of each crimp-style terminal 5, and then the crimp-style terminals 5 are received respectively in the terminal receiving chambers 4 from the upper side. At this time, the wire W is passed through the slit 8 from the outer peripheral surface of the mat seal 6, and is received in the wire seal hole 7. After the required number of crimp-style terminals 5 are all received respectively in the terminal receiving chambers 4, the cover 3 is fitted on the housing body 2 from the front side thereof.

Therefore, the outer peripheral surface of the mat seal 6 is fitted in an inner peripheral surface of the rear end portion of the cover 3, and the front surface of the mat seal 6 is abutted against the rear end surface of the cover 3. After the groups of wires W are received in the respective U-shaped openings 10B in the rear holder 10, the rear holder 10 is fitted on the cover 3, and the retaining pawls 10A are engaged with the retaining projections 3A, respectively. At this time, the mat seal 6 is pressed toward the cover 3.

At this time, each tapering projection 11 of a larger volume is pressed into the associated pressing hole 9 of a smaller volume as shown in FIG. 4, so that the pressing hole 9 is increased or expanded in diameter by the volume and the tapering surface of the tapering projection 11. And besides, since each pair of pressing holes 9 are disposed respectively on the opposite sides of the associated slit 8, the slit 8 is pressed from the opposite sides.

Thus, the slit 8 is pressed from the opposite sides, and therefore the opposed surfaces of the slit 8 are pressed into intimate contact with each other, thereby completely eliminating a gap defined by the slit 8, and the intrusion of water and the like through the slit 8 is positively prevented. The wire seal hole 7 prevents the intrusion of water along the wire W, and the outer peripheral surface of the mat seal 6 prevents the intrusion of water from the rear end portion of the cover 3. Therefore, the intrusion of water and the like into the housing body 2 is positively prevented.

As described above, in the waterproof connector of this embodiment, each wire W is mounted in the associated wire seal hole 7 through the associated slit 8, and therefore the efficiency of the assembling operation is enhanced.

And besides, there is no need to pass the crimp-style terminal 5 through the wire seal hole 7 from one side of the mat seal, and therefore the wire seal hole 7 will not be damaged, and the intrusion of water along the wire W is completely prevented, thereby enhancing the reliability.

Next, a second embodiment of a waterproof connector of the invention will be described in detail with reference to FIG. 5. In this embodiment, a housing body 22, having a plurality of terminal receiving chambers 4, is molded integrally with a cover 23, and is disposed within this cover 23, and tapering projections 11 are formed on a rear surface of the cover 23, and pressing holes 9 are formed in a front surface of a mat seal 26.

Thus, the tapering projections 11 are not formed on a rear holder 30, and those portions identical in construction to those of the first embodiment are designated by identical reference numerals, respectively, and explanation thereof will be omitted.

With respect to an assembling procedure, a group of wires W each clamped to a rear end of a crimp-style terminal 5 are first mounted respectively in wire seal holes 7 through respective slits 8, and then the group of crimp-style terminals 5 are inserted at a time into the housing body 22. Therefore, the insertion of the crimp-style terminals 5 can be effected, for example, with the rear surface of the cover 23 directed upwardly, and therefore the efficiency of the operation can be further enhanced.

The waterproof connectors of the present invention are not limited to the above embodiments, and various modifications can be made. For example, in the first embodiment, although the pressing holes 9 as well as the tapering projections 11 have a conical shape, the pressing holes 9 may have a cylindrical shape. However, the tapering projection 11 need to have a certain degree of tapering or curved surface so as to increase the diameter of the pressing hole.

As described above, in the waterproof connector of, the slits are formed in the mat seal, and extend respectively from the wire seal holes to the outer peripheral surface of the mat seal, and the pressing holes are formed in the rear surface of the mat seal in such a manner that each of the slits is disposed between the corresponding adjacent pressing holes, and the tapering projections are formed on the front surface of the rear holder, and are pressed respectively into the pressing holes to increase the diameters of the pressing holes, respectively.

Since the slits are formed in the mat seal, the insertion of the wires through the respective wire seal holes can be effected easily, and the efficiency of the assembling operation is markedly enhanced.

And besides, since the tapering projections are pressed respectively into the pressing holes, the slits are pressed from the opposite sides, thereby positively preventing the intrusion of water and the like, thus enhancing the waterproof effect.

In the waterproof connector of the present invention, the slits are formed in the mat seal, and extend respectively from the wire seal holes to the outer peripheral surface of the mat seal, and the pressing holes are formed in the front surface of the mat seal in such a manner that each of the slits is disposed between the corresponding adjacent pressing holes, and the tapering projections are formed on the rear surface of the cover, and are pressed respectively into the pressing holes to increase the diameters of the pressing holes, respectively, and the housing body is molded integrally with the cover, and is disposed within the cover.

Therefore, the crimp-style terminals, clamped respectively to the wires, are first mounted respectively in the wire seal holes, and then are inserted respectively into the terminal receiving chambers, and therefore the assembling operation can be effected more easily, and the efficiency of the operation is further enhanced.

In the waterproof connector of the present invention, each of the pressing holes is a conical hole, and each of the tapering projections is a conical projection larger in volume than the conical hole. Therefore, the molding can be effected easily, and the production cost can be reduced.

In the waterproof connector of the present invention, each of the pressing holes is a triangular prism-shaped hole of a V-shaped cross-section extending in a direction of extending of the slit, and each of the tapering projections is a triangular prism-shaped projection larger in volume than the triangular prism-shaped hole. Therefore, the tapering projections have an increased rigidity, and the length of application of the pressure to the slit is increased, and the waterproof effect at the slits is further enhanced, and the waterproof connector of a higher reliability can be obtained.

What is claimed is:

1. A waterproof connector comprising:

a housing body having a plurality of terminal receiving chambers for respectively receiving a plurality of crimp terminals each clamped to an end of a wire;

a cover covering said housing body from a front side thereof;

a mat seal of an elastic material fitted in a rear end portion of said cover, and having a plurality of wire seal holes;

a rear holder fitted on said mat seal from a rear side thereof, and engaged with said cover;

slits formed in said mat seal, and extend respectively from said wire seal holes to an outer peripheral surface of said mat seal;

pressing holes formed in a rear surface of said mat seal in such a manner that each of said slits is disposed between a corresponding pair of adjacent pressing holes; and tapering projections formed on a front surface of said rear holder, and pressed respectively into said pressing holes to increase diameters of said pressing holes, respectively for enhancing a waterproof effect.

2. A waterproof connector according to claim 1, in which each of said pressing holes is a conical hole, and each of said tapering projections is a conical projection larger in volume than said conical hole.

3. A waterproof connector according to claim 1, in which each of said pressing holes is a triangular prism-shaped hole of a V-shaped cross-section extending in a direction of extending of said slit, and each of said tapering projections is a triangular prism-shaped projection larger in volume than said triangular prism-shaped hole.

4. A waterproof connector comprising:

a housing body having a plurality of terminal receiving chambers for respectively receiving a plurality of crimp terminals each clamped to an end of a wire;

a cover covering said housing body from a front side thereof;

a mat seal of an elastic material fitted in a rear end portion of said cover, and having a plurality of wire seal holes;

a rear holder fitted on said mat seal from a rear side thereof, and engaged with said cover;

slits formed in said mat seal, and extend respectively from said wire seal holes to an outer peripheral surface of said mat seal;

pressing holes formed in a front surface of said mat seal in such a manner that each of said slits is disposed between a corresponding pair of adjacent pressing holes;

tapering projections formed on a rear surface of said cover, and pressed respectively into said pressing holes to increase diameters of said pressing holes, respectively for enhancing a waterproof effect, wherein said housing body is molded integrally with said cover, and is disposed within said cover.

5. A waterproof connector according to claim 1, in which each of said pressing holes is a conical hole, and each of said tapering projections is a conical projection larger in volume than said conical hole.

6. A waterproof connector according to claim 1, in which each of said pressing holes is a triangular prism-shaped hole of a V-shaped cross-section extending in a direction of extending of said slit, and each of said tapering projections is a triangular prism-shaped projection larger in volume than said triangular prism-shaped hole.

* * * * *